US005775061A

United States Patent [19]

Enneking et al.

[11] Patent Number: 5,775,061

[45] Date of Patent: Jul. 7, 1998

[54] METHOD OF SHIPPING AND ASSEMBLING BURIAL CASKET AND CASKET SHIPPED AND ASSEMBLED BY SUCH METHOD

[75] Inventors: John R. Enneking; Gary L. Henby; Wilbur A. Schebler, all of Batesville, Ind.; Patrick M. Saaf, Manchester, N.H.; Eugene A. Ritter, Batesville, Ind.; Andrew Capogrosso, Fremont, Ohio

[73] Assignee: Batesville Casket Company, Inc., Batesville, Ind.

[21] Appl. No.: 594,027

[22] Filed: Feb. 20, 1996

Related U.S. Application Data

[63] Continuation-in-part of Ser. No. 564,387, Nov. 29, 1995, abandoned.

[51] Int. Cl.[6] ..... B65B 61/20; B65B 5/02; B65B 43/26

[52] U.S. Cl. ..... 53/445; 53/458; 53/471; 53/474; 53/485; 53/492

[58] Field of Search ..... 53/445, 458, 474, 53/471, 485, 155, 238, 492; 206/223, 577; 220/4.28, 4.33; 27/2, 4, 35

[56] References Cited

U.S. PATENT DOCUMENTS

| | | | |
|---|---|---|---|
| 1,807,770 | 6/1931 | Beaman . | |
| 2,673,596 | 3/1954 | Haase | 206/577 X |
| 3,511,429 | 5/1970 | Brian . | |
| 3,782,619 | 1/1974 | Dittbenner . | |
| 3,904,106 | 9/1975 | Elder . | |
| 4,063,337 | 12/1977 | Havey, III . | |
| 4,123,831 | 11/1978 | Covington . | |
| 4,151,630 | 5/1979 | Havey . | |
| 4,170,054 | 10/1979 | Ruffner et al. . | |
| 4,176,431 | 12/1979 | Havey, III . | |
| 4,305,186 | 12/1981 | Cherry . | |
| 4,512,477 | 4/1985 | Densen | 206/577 |
| 4,765,535 | 8/1988 | Michetti . | |
| 4,949,900 | 8/1990 | Ballu . | |
| 4,998,669 | 3/1991 | Karolyi . | |

*Primary Examiner*—Linda Johnson
*Attorney, Agent, or Firm*—Wood, Herron & Evans, L.L.P.

[57] ABSTRACT

A method of shipping a burial casket in a knocked-down configuration and subsequently assembling the casket at its point of destination comprises the steps of providing a kit of disassembled casket components assemblable into a casket having a shell and a cap, packing the kit of components into shipping container, shipping the packaged casket kit to a destination point, removing the kit from the container and assembling the casket from the kit utilizing at least a portion of the shipping container as an interior component of the casket. A casket comprises a shell and cap assembled from a kit shipped in knocked-down configuration, a body support structure positioned in the shell for supporting a body and a floor for the casket upon which to support the body support structure in the shell. The body support structure is formed from the bottom of an elongated, shallow, generally rectangular shipping carton in which the casket kit is shipped. The floor is formed from the top of the carton. The top of the carton can also be utilized to form a liquid retaining tray.

23 Claims, 10 Drawing Sheets

METHOD OF SHIPPING AND ASSEMBLING BURIAL CASKET AND CASKET SHIPPED AND ASSEMBLED BY SUCH METHOD

RELATED APPLICATIONS

This application is a continuation-in-part application of application Ser. No. 08/564,387, filed Nov. 29, 1995, now abandoned, the entire substance of which is hereby incorporated by reference herein as if fully set forth in its entirety.

FIELD OF THE INVENTION

This invention relates generally to burial caskets, and more particularly to a method of shipment of a burial casket in a knocked-down configuration and subsequent assembly of the casket at its point of destination as well as a casket shipped and assembled by the method.

BACKGROUND OF THE INVENTION

A casket comprises a large shell to which is pivoted a cap or lid. Caskets are generally expensive to ship due to the large volume of wasted space which is the interior of the casket.

So-called ready-to-assemble caskets have been proposed in order to provide more economical shipping of caskets. A ready-to-assemble ("RA") casket is generally shipped in a knocked-down kit configuration, that is, is shipped as a kit of disassembled casket components, for example a pair of shell side walls, a pair of shell end walls, a shell bottom wall, and a cap. The disassembled casket components may be shipped in a shipping container which is substantially smaller than a container for containing an assembled casket. Thus, for a given volume, a greater number of caskets may be shipped in RA form than in preassembled form thereby producing a substantial shipping cost savings.

One criticism in the shipping of RA caskets, and many other products for that matter, is the amount of waste generated at the shipping destination point of the caskets. The RA casket is removed from its shipping container, is assembled and readied for sale. The shipping containers, normally fabricated of corrugated board otherwise known as cardboard, must either be disposed of or transported to a recycling station for recycling. The cost of this discarded and, prior to the present invention, unusable, shipping container traditionally is reflected in the cost of the end product—the casket—thus increasing the casket's cost.

In addition to being utilized in the construction of shipping cartons cardboard has also been employed in the construction of combustible caskets used in the cremation industry or so-called crematable caskets. Cardboard has the advantage of being much less expensive than wood but suffers however from the drawbacks that it is not as aesthetically pleasing visually as are caskets fabricated from wood or other materials such as hardboard and also cardboard is not as structurally stiff as some of these other materials used for fabricating crematable caskets and thus has a lesser load carrying or bearing capacity. Cardboard can though be successfully employed in crematable caskets for components which do not carry great loads and which also are not ordinarily visible to an observer of the casket due to their being covered by the decorative fabric interior of the casket or otherwise to their placement within the casket.

It is therefore one objective of the present invention to reduce shipping container waste at the point of destination of RA caskets.

It is another objective of the present invention to reduce the need to transport discarded shipping containers in which RA caskets have been shipped to a recycling station for recycling.

It is yet another objective of the present invention to reduce the shipping costs associated with shipping caskets in general and RA caskets in particular.

It is still another objective of the present invention to utilize cardboard as a material with which to fabricate at least some components of a crematable casket, which components are not required to carry great loads and are not readily visible to an observer.

SUMMARY OF THE INVENTION

The present invention attains these objectives by providing a method of shipping a burial casket in a knocked-down configuration and subsequently assembling the casket at its point of destination. The method comprises the steps of providing a kit of disassembled casket components assemblable into a casket having a shell and a cap, packing the kit of components into shipping container, shipping the packaged casket kit to a destination point and removing the kit from the container. The casket is assembled from the kit and at least a portion of the shipping container is utilized as an interior component of the casket.

In a preferred embodiment, the shipping container is an elongated, shallow, generally rectangular carton having a bottom and a top which fits over the bottom. The step of utilizing at least a portion of the shipping container as a component of the casket comprises the steps of utilizing the carton bottom as a body support structure for supporting a body thereatop in the casket and utilizing the carton top as a floor for the casket upon which to support the body support structure in the casket. The casket and carton are preferably fabricated from combustible material in order that the casket be crematable; preferable materials are hardboard and wood for the casket and cardboard for the shipping carton.

In another aspect of the present invention, there is provided a combination casket kit and shipping carton. The combination comprises a kit of disassembled casket components shippable in a knocked-down configuration and assemblable into a casket having a shell and a cap and a carton into which is received the kit and in which is shipped the kit to a destination point. At least a portion of the carton is adapted to form an interior component of the casket assembled from the kit.

In yet another aspect of the present invention, a casket is provided. The casket comprises a shell and a cap enclosing the shell, the shell and cap being assembled from a kit of disassembled casket components shippable in a knocked-down configuration. In one embodiment a body support structure is positioned in the shell for supporting a body thereatop. The body support structure is formed from either the bottom or the top of an elongated, shallow, generally rectangular shipping carton in which the kit of casket components is shipped. In another embodiment, a floor is positioned in the shell for supporting a body in the shell. The floor is formed from either the top or the bottom of the shipping carton. In a preferred embodiment, the casket includes both the body support structure and the floor; the body support structure is formed from the bottom of the shipping carton and the floor is formed from the top of the shipping carton.

In still another aspect of the present invention, a self-supporting body support structure for a casket is provided. The body support structure is fabricated from a sheet of cardboard and comprises a planar body supporting portion having a pair of lateral edges and longitudinal supporting structure along each lateral edge of the body supporting portion for supporting the lateral edges of the body supporting portion above the bottom of the casket. Each longitudinal supporting structure is formed by folding a lateral edge portion of the cardboard sheet beneath the body supporting portion. A plurality of supports is spaced laterally between the longitudinal supporting structures and longitudinally the length of the body supporting portion and supports the body supporting portion between the longitudinal supporting structures and along the length of the body supporting portion above the bottom of the casket. Each support is formed by folding a first tab portion of the cardboard sheet beneath the body supporting portion.

Each longitudinal supporting structure preferably comprises a first panel portion of the cardboard sheet foldably connected to the body supporting portion along adjacent edges thereof, and a second panel portion of the cardboard sheet foldably connected to the first panel portion along adjacent edges thereof. The first panel portion is folded to be generally perpendicular to the body supporting portion, and the second panel portion is folded to underlie the body supporting portion.

Each of the plurality of supports is further formed by folding a second tab portion of the cardboard sheet beneath the body supporting portion and engaging respective notches in the free edges of the first and second tab portions to lock the first and second tab portions together.

Each of the plurality of supports is preferably further formed by folding a third tab portion of the cardboard sheet beneath the body supporting portion and engaging respective notches in the free edges of the first and third tab portions to lock the first and third tab portions together.

The first tab portion preferably comprises a first panel portion of the cardboard sheet foldably connected to the body supporting portion along adjacent edges thereof, a second panel portion of the cardboard sheet foldably connected to the first panel portion along adjacent edges thereof, and a third panel portion of the cardboard sheet foldably connected to the second panel portion along adjacent edges thereof. The first tab portion notches are in the free edge of the third panel portion of the first tab portion, and the first panel portion is generally perpendicular to the body supporting portion when the first tab portion notches are engaged with the second and third tab portion notches. The second and third tab portions are preferably folded along respective fold lines with respect to the body supporting portion which are generally perpendicular a fold line about which the first panel portion of the first tab portion is folded with respect to the body supporting portion.

The first and second panel portions of each longitudinal supporting structure are folded along a fold line, and each of the panel portions preferably includes a portion of a notch of a series of notches along and spanning the fold line. Each notch is for accepting a respective upstanding rib amongst a plurality of upstanding ribs in the bottom of a liquid retaining tray.

The third panel portion of the first tab portion has a pair of lateral edges. The free edge of each of the longitudinal supporting structure second panel portions is retained by one edge of the third tab portion pair of lateral edges thus retaining the longitudinal supporting structures folded.

The present invention also provides a casket including such a body support structure.

According to a further aspect of the present invention, a floor for a casket is provided. The casket floor is fabricated from a sheet of cardboard and has a generally planar floor portion having a pair of lateral edges, longitudinal reinforcing structure along each lateral edge of the floor portion for reinforcing the lateral edges of the floor portion, and torso reinforcing structure located intermediate the ends of the floor portion for reinforcing the floor portion in the region of the torso of a body. Each longitudinal reinforcing structure is formed by folding a lateral edge portion of the cardboard sheet beneath the floor portion. The torso reinforcing structure is formed by folding the cardboard sheet in a lapped configuration.

In an alternative embodiment, a floor for a casket is provided which comprises a generally planar floor portion having a double-thickness formed by folding the cardboard sheet along a longitudinal center line. Head and foot end reinforcing structures are formed by folding head and foot end portions of the floor portion beneath the balance of the floor portion.

The present invention also provides a casket including such a floor.

According to yet a further aspect of the present invention, a cardboard blank from which can be constructed both a shipping carton bottom and a casket body support structure is provided. A sheet of cardboard has a pair of opposed lateral edges and a pair of opposed end edges and defines a carton bottom floor and a body support structure planar body supporting portion. A first longitudinal pair of score lines defines a pair of carton bottom side walls and a second panel portion of each of a pair of body supporting portion lateral edge longitudinal supporting structures, with one score line of the first pair of score lines being located inboard of each lateral edge of the sheet. A second longitudinal pair of score lines defines, with the first longitudinal pair of score lines, a first panel portion of each of the pair of body supporting portion lateral edge longitudinal supporting structures, with one score line of the second pair of score lines being located inboard of each score line of the first pair of score lines. A transverse score line is inboard of each end edge and defines a carton bottom end wall. A pair of longitudinal cut lines is in each end edge further defining the end wall and defining a pair of end flaps, with one cut line of the pair of longitudinal cut lines extending inwardly from a respective end edge to a respective transverse score line and to a respective end of a respective longitudinal score line of the first longitudinal pair of score lines. A transverse cut line extends partially laterally outwardly from each longitudinal cut line and defines a locking tab of each end flap. A notch is in each end wall and accepts a respective locking tab of the end flaps. A plurality of first support cuts are between the second longitudinal pair of score lines and along the length of the sheet, with each support cut of the plurality of the first support cuts defining a first tab portion of a support foldable beneath the body supporting portion.

The blank further preferably includes a plurality of second support cuts and a plurality of third support cuts defining second and third tab portions respectively of the support which are foldable beneath the body supporting portion. The second and third support cuts include a notch therein defining a notch in each of the second and third tab portions. The first support cut includes a pair of notches therein defining a pair of notches in the first tab portion. Each of the first tab portion notches are engagable with one of the second and third tab portion notches.

The blank further preferably includes a line of perforations inboard of each transverse score line whereby the carton bottom end wall and end flaps can be torn away from the body support structure and discarded.

The blank further preferably includes a plurality of cuts defining a series of notch forming tabs along and spanning each score line of the first longitudinal pair of score lines.

According to still a further aspect of the present invention, a cardboard blank from which can be constructed both a shipping carton top and a casket floor is provided. A sheet of cardboard has a pair of opposed lateral edges and a pair of opposed end edges and defines a carton top ceiling and a casket floor portion. A first longitudinal pair of score lines defines a pair of carton top side walls, with one score line of the first pair of score lines being located inboard of each lateral edge of the sheet. A second longitudinal pair of score lines defines lateral edges and longitudinal reinforcing structure for each lateral edge of the floor portion, with one score line of the second pair of score lines being located inboard of each score line of the first pair of score lines. A transverse score line is inboard of each end edge and defines a carton top end wall. A pair of longitudinal cut lines is in each end edge further defining the end wall and defining a pair of end flaps, with one cut line of the pair of longitudinal cut lines extending inwardly from a respective end edge to a respective transverse score line and to a respective end of a respective longitudinal score line of the first longitudinal pair of score lines. A transverse cut line extends partially laterally outwardly from each longitudinal cut line and defines a locking tab of each end flap. A notch is in each end wall and accepts a respective locking tab of the end flaps. Are pair of transverse core lines are intermediate the end edges and define torso reinforcing structure formed by folding the cardboard sheet in a lapped configuration.

In an alternative embodiment of cardboard blank from which can be constructed both a shipping carton top and a casket floor, the blank has a longitudinal center score line defining top and bottom thicknesses of the floor portion. A second pair of transverse score lines are provided inboard of said first pair of transverse score lines and define head and foot end reinforcing structure formed by folding head and foot end portions of the floor portion along the second pair of transverse score lines beneath the balance of the floor portion.

In yet a further aspect of the present invention, the step of utilizing at least a portion of the shipping container as a component of the casket in the method of shipping the burial casket in knocked down configuration and subsequently assembling the casket at its point of destination, comprises utilizing the carton top as a liquid retaining tray for the casket in which to retain liquids of decomposition of a deceased.

In still a further aspect, in the combination casket kit and shipping carton, the carton top forms a liquid retaining tray for the casket in which to retain liquids of decomposition of a deceased.

In yet another aspect, the casket includes a liquid retaining tray formed from the top of the shipping carton.

In still another aspect, a liquid retaining tray fabricated from a sheet of cardboard comprises a bottom, a pair of side walls connected to the bottom and a pair of end walls connected to the bottom. Adjacent ends of the side and end walls form corner structures. Each corner structure is formed by folding a portion of both adjacent ends of the side and end walls diagonally inwardly. One of the side wall end and end wall end portions has a tabbed portion and the other of the side wall end and end wall end portions has a slot therein. The tabbed portion is received in the slot.

In still another aspect, a cardboard blank from which can be constructed both a shipping carton top and a liquid retaining tray is provided. The cardboard blank comprises a sheet of cardboard having a pair of opposed lateral edges and a pair of opposed end edges and defining a carton top ceiling and a casket tray floor portion. A first longitudinal pair of score lines define a pair of carton top side walls. A second longitudinal pair of score lines inboard of the first longitudinal pair of score lines define a pair of liquid retaining tray side walls. A first transverse pair of score lines define a pair of carton top end walls. A second transverse pair of score lines inboard of the first transverse pair of score lines define a pair of liquid retaining tray end walls. A score line extends diagonally from each intersection of the ends of the second longitudinal pair of score lines and the second transverse pair of score lines to each respective intersection of the ends of the first longitudinal pair of score lines and the first transverse pair of score lines. A longitudinal cut line extends from each intersection of the ends of the first longitudinal pair of score lines and the first transverse pair of score lines to a respective end edge of the blank. A transverse cut line extends from the longitudinal cut line partially outwardly defining a locking tab. There is a notch in each of the carton top end walls for accepting the locking tab.

One advantage of the present invention is that a method of shipping and assembling a casket and a casket shipped and assembled by the method are provided which reduce the shipping container waste generated at the point of destination of RA caskets.

Another advantage of the present invention is that a method of shipping and assembling a casket and a casket shipped and assembled by the method are provided which reduce the need to transport discarded shipping containers in which RA caskets have been shipped to a recycling station for recycling.

Yet another advantage of the present invention is that a method of shipping and assembling a casket and a casket shipped and assembled by the method are provided which reduce the shipping costs associated with shipping caskets in general and RA caskets in particular.

Still another advantage of the present invention is that a method of shipping and assembling a casket and a casket shipped and assembled by the method are provided which utilize cardboard as a material with which to fabricate at least some components of a crematable casket.

These and other objects and advantages of the present invention will become more readily apparent during the following detailed description taken in conjunction with the drawings herein, in which:

DETAILED DESCRIPTION OF THE INVENTION

Figure 1:
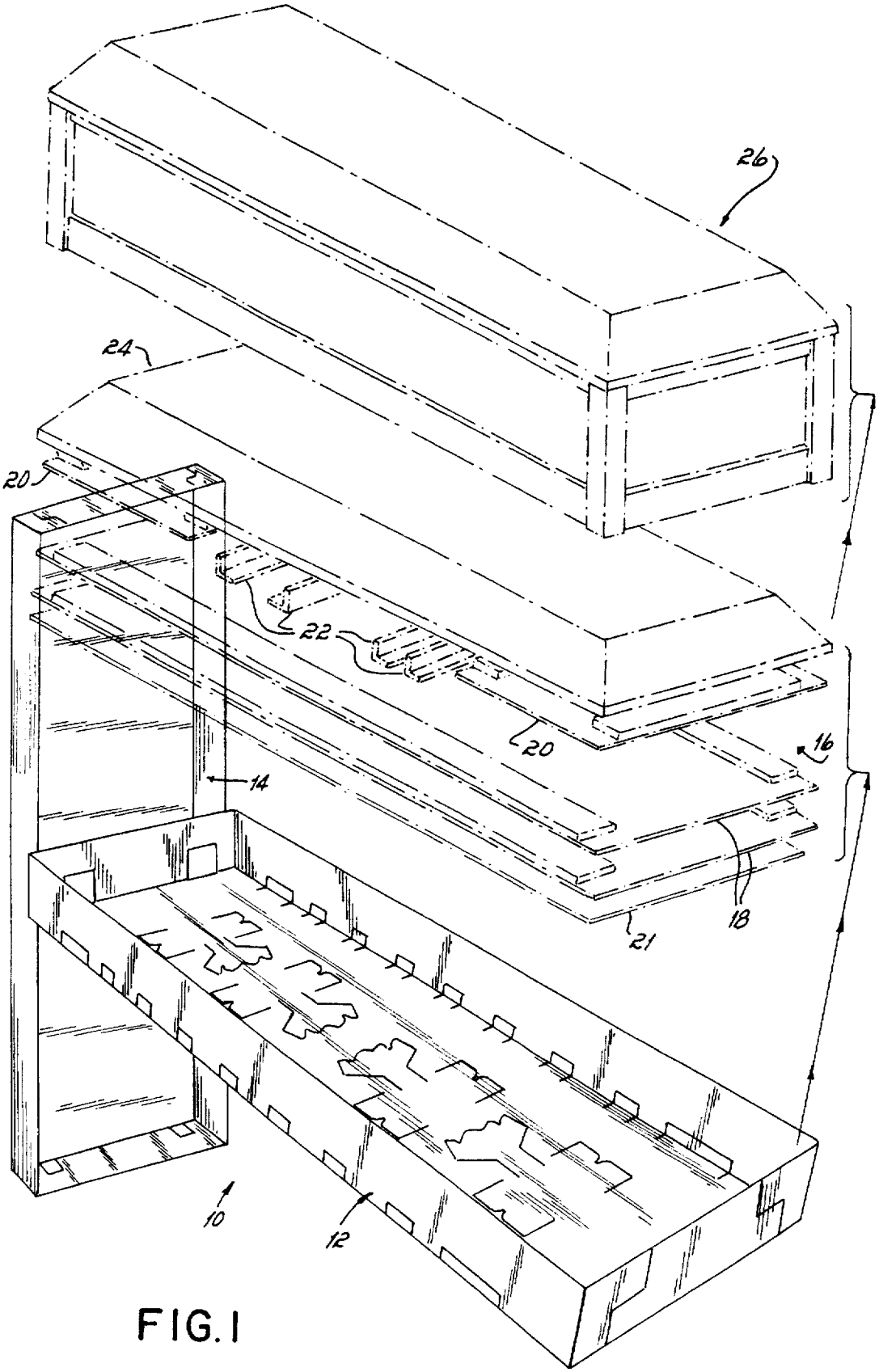
FIG. 1 is an exploded perspective view of a casket kit shippable in a knocked-down configuration, a carton in which the casket kit is shipped and a casket assembled from the kit according to the principles of the present invention.

Referring first to FIG. 1, there is illustrated a shipping container 10 for shipping an RA burial casket in knocked-down configuration for subsequent assembly of the casket at a destination point, the assembled casket to include a portion of the container 10 as an interior component of the casket. The shipping container 10 comprises a container bottom 12 and a container top 14 which fits atop the container bottom 12. The carton 10 is generally sized to hold a kit 16 of casket components which are shipped in knocked-down configuration for subsequent assembly at the point of destination. The kit 16 may include, for example, a pair of casket shell side walls 18, 18, a pair of shell end walls 20, 20, a shell external bottom wall 21, four corner supports 22, a cap 24 and other associated hardware and the like for assembling the kit 16 into a completed casket, as shown at 26. One such RA casket which may be shipped in the carton 10 is disclosed in U.S. patent application Ser. No. 08/459,736, filed Jun. 2, 1995, assigned to the assignee of the present invention, the entire substance of which is hereby incorporated by reference herein as if fully set forth in its entirety. In that application, an RA casket includes rectangular wood frames to which are attached hardboard panels to form the casket shell side, end and bottom walls. The casket also includes a rectangular wood cap rim to which is attached a hardboard panel to form the cap crown. Cam and post quick connect fasteners are utilized to attach the frame members of the casket shell together and to attach the rim members of the cap together.

Figure 2:
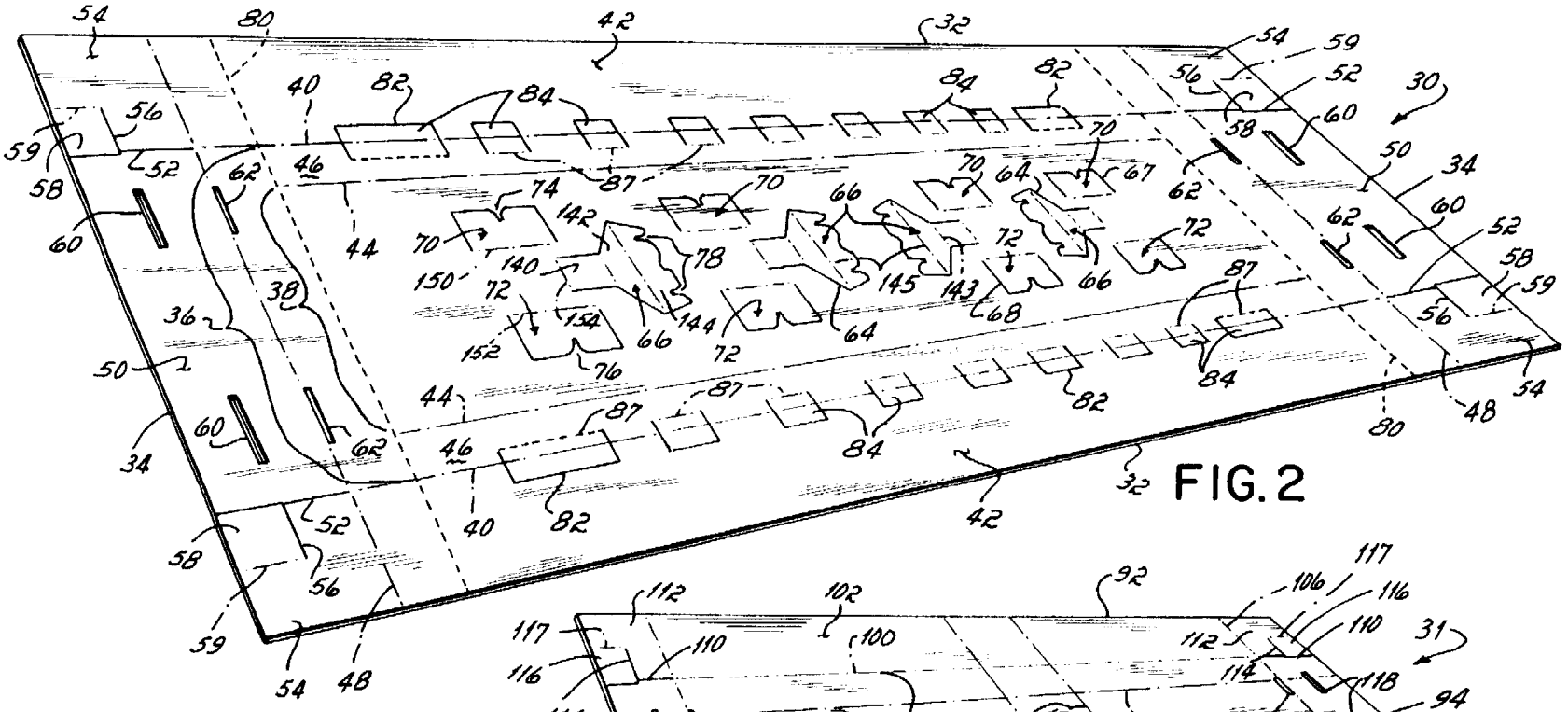
FIG. 2 is a perspective view of a blank for constructing both the bottom of the FIG. 1 carton and a body support structure.
Figure 3:
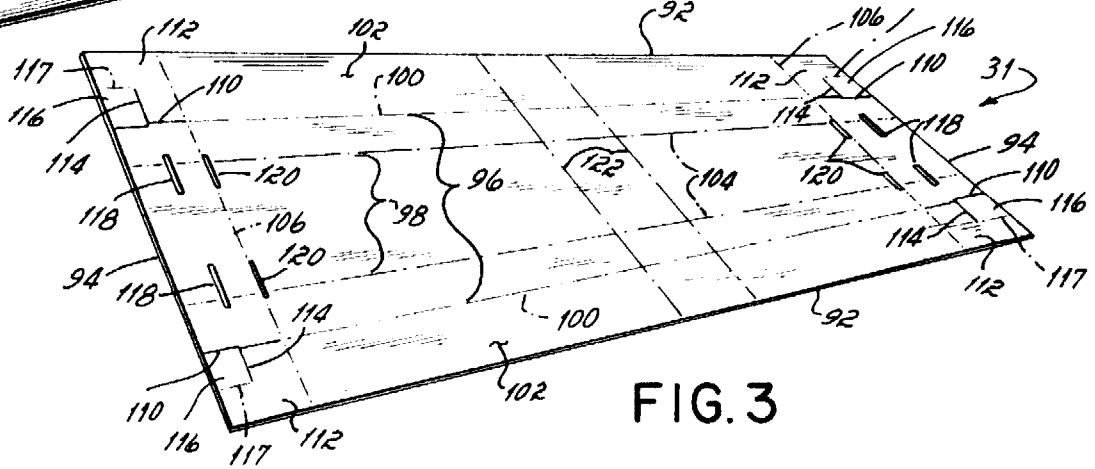
FIG. 3 is a perspective view of a blank for constructing both the top of the FIG. 1 carton and a floor for the casket.

Referring now to FIGS. 2 and 3, there are illustrated blanks 30 and 31 fabricated from cardboard sheet material which are erectable into the carton bottom 12 and carton top 14, respectively. Referring first to FIG. 2, the blank 30 is a cardboard blank from which can be constructed both the shipping carton bottom 12 and a casket body support structure 130 which will be subsequently described. The blank 30 includes a pair of opposed lateral edges 32, 32 and a pair of opposed end edges 34, 34 within the perimeter of which define a carton bottom floor 36 and a body support structure planar body supporting portion 38. A first longitudinal pair of score or fold lines 40, 40 define both a pair of carton bottom side walls 42, 42 and second panel portions 42, 42 of each of a pair of body supporting portion lateral edge longitudinal supporting structures 134 which will be subsequently described. As used herein, the terms "score lines" and "fold lines" are used interchangeably. A second longitudinal pair of score lines 44, 44 define, with the first longitudinal pair of score lines 40, 40, a first panel portion 46 of each of the pair of body supporting portion lateral edge longitudinal supporting structures 134 referred to above which will be subsequently described. A transverse score line 48 is inboard of each end edge 34 and defines a carton bottom end wall 50. A pair of longitudinal cut lines 52, 52 in each end edge 34 define the end wall 50 and a pair of end flaps 54, 54. One cut line 52 of each of the pair of longitudinal cut lines 52, 52 extends inwardly from a respective end edge 34 to a respective transverse score line 48 and to a respective end of a respective longitudinal score line 40 of the first longitudinal pair of score lines 40, 40. A transverse cut line 56 extends partially laterally outwardly from each longitudinal cut line 52 and defines a locking tab 58 in each end flap 54 foldable about a score line 59. A pair of notches 60, 60 in each end wall 50 accept the locking tabs 58, 58 of the end flaps 54, 54. A second pair of notches 62, 62 in the portion of the blank 30 from which is formed the carton bottom floor 36, adjacent each transverse score line 48, also accept the locking tabs 58, 58 of the end flaps 54, 54 as will be subsequently described. A plurality of first support cuts 64 between the second longitudinal pair of score lines 44, 44 and along the length of the blank 30 define a plurality of first tab portions 66 foldable beneath the body supporting portion 38 of the body support structure, which will be subsequently described in more detail.

The blank 30 further includes a plurality of second support cuts 67 and a plurality of third support cuts 68, defining second and third tab portions 70, 72 respectively foldable beneath the body supporting portion 38 as will be subsequently described in more detail. The second and third support cuts 67, 68 each include a respective notch 74, 76 defining a notch in each of the second and third tab portions 70, 72 respectively. The first support cut 64 includes a pair of notches 78, 78 defining a pair of notches in the first tab portion 66, each of which is engagable with one of the second and third tab portion notches 74, 76.

The blank 30 further includes a transverse line of perforations 80 inboard of each transverse score line 48 whereby the carton bottom end wall and end flaps 50, 54 can be torn away from the body support structure and discarded, as will be subsequently described in more detail.

The blank 30 further includes a plurality of cuts 82 defining a series of notch forming tabs 84 along and spanning each score line 40 of the first longitudinal pair of score lines 40,40, for a purpose which will be subsequently described.

Figures 4, 5:
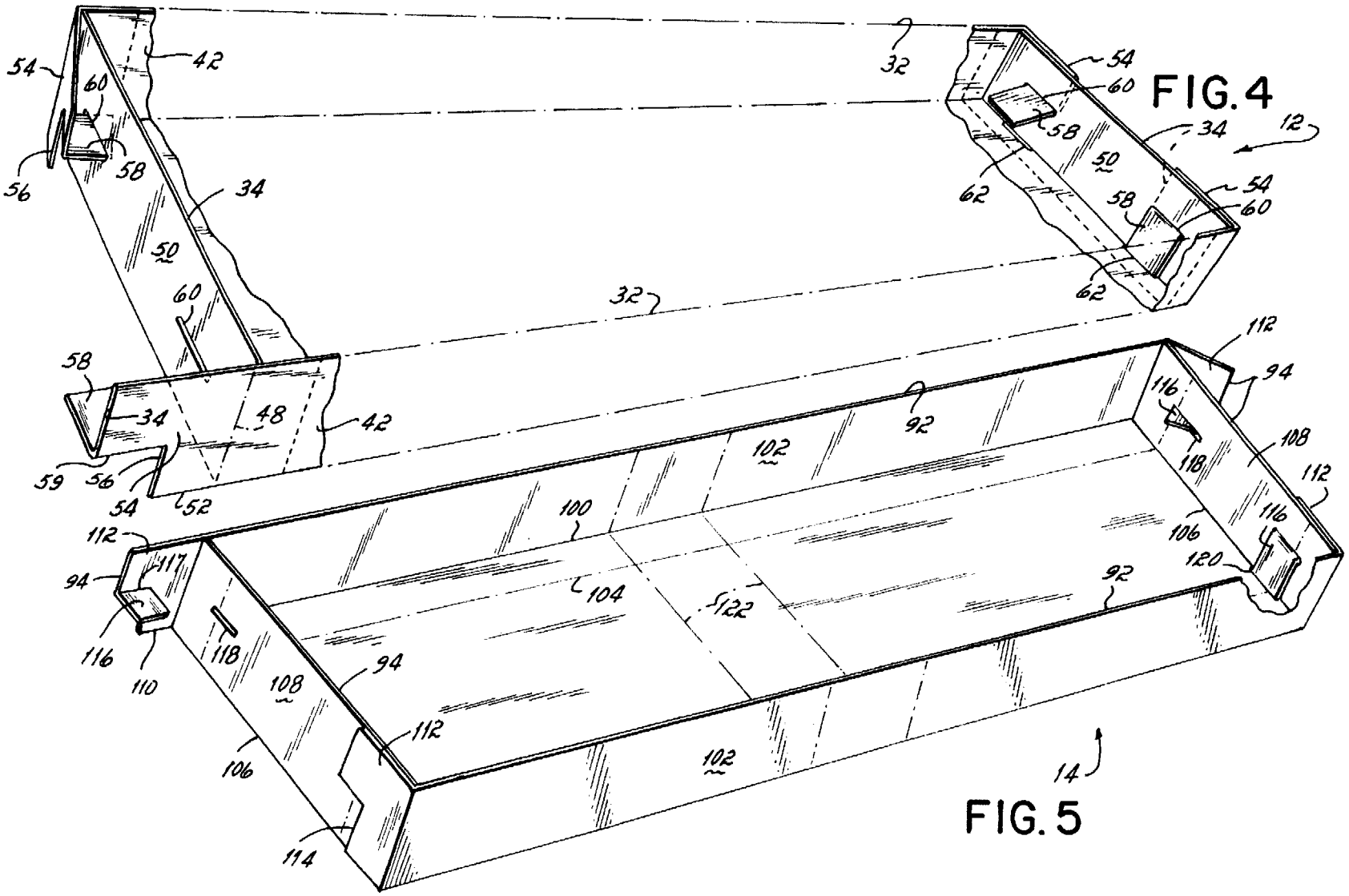
FIG. 4 is a perspective view of the carton bottom being constructed from the blank of FIG. 2.
FIG. 5 is a perspective view of the carton top being constructed from the blank of FIG. 3.

Referring now to FIG. 4, the blank 30 is shown being assembled into the carton bottom 12. The end walls 50, 50 are first folded upwardly about score lines 48, 48 and then carton bottom side walls 42, 42 are folded upwardly about score lines 40, 40. End flaps 54, 54 are folded about a respective score line 48 inwardly about each of the end walls 50, 50, and the locking tab 58 of each end flap 54 is folded about score line 59 upwardly and inserted first through a respective slot 60 and then into a respective slot 62 in a respective end wall 50 thereby locking the side walls 42, 42 and end walls 50, 50 in their upright, erected positions.

Referring now to FIG. 3, the cardboard blank 31 from which can be constructed both the shipping carton top 14 and a casket floor which will be subsequently described is illustrated. The blank 31 includes a pair of opposed lateral edges 92, 92 and a pair of opposed edges 94, 94 defining a carton top ceiling 96 and a casket floor portion 98. A first longitudinal pair of score lines 100, 100 defines a pair of carton top side walls 102, 102. A second longitudinal pair of score lines 104, 104 defines the lateral edges of the floor portion 98 and longitudinal reinforcing structure for each lateral edge of the floor portion 98. A transverse score line 106 inboard of each end edge 94 defines a carton top end wall 108. A pair of longitudinal cut lines 110, 110 in each end edge 94 further defines each end wall 94 and also defines a pair of end flaps 112, 112. One cut line of the pair of cut lines 110, 110 extends inwardly from a respective end edge 94 to a respective transverse score line 106 and to a respective end of a respective longitudinal score line 100 of the first longitudinal pair of score lines 100, 100. A transverse cut line 114 extends partially laterally outwardly from each longitudinal cut line 110 and defines a locking tab 116 of each end flap 112 foldable about a score line 117. A pair of notches 118, 118 in each end wall 108 accept the locking tabs 116, 116 of the end flaps 112, 112. A second pair of notches 120, 120 in the carton top ceiling 96 adjacent each transverse score line 114 are also for accepting the locking tabs 116, 116 of the end flaps 112, 112. A pair of transverse score lines 122, 122 intermediate the end edges 94, 94 define torso reinforcing structure formed by folding the cardboard sheet in a lapped configuration, which will be subsequently described in more detail.

Referring now to FIG. 4, it will be seen that the carton top 14 is assembled from its blank 31 in much the same manner as the carton bottom 12 is formed from its blank 30. The end walls 108, 108 are first folded upwardly about score lines 106, 106, and then the side walls 102, 102 are folded upwardly about score lines 100, 100. The locking tab 116 in each end flap 112 is folded upwardly about score line 117, and the end flaps 112, 112 are folded at respective score lines 106 about the end walls 108, 108. Locking tabs 116 are inserted through notches 118 and 120 thus forming the erected carton top 14.

The carton 10 is thus erected and is ready for accepting the kit 16 of casket components therein for shipment to a destination point.

Figure 10:
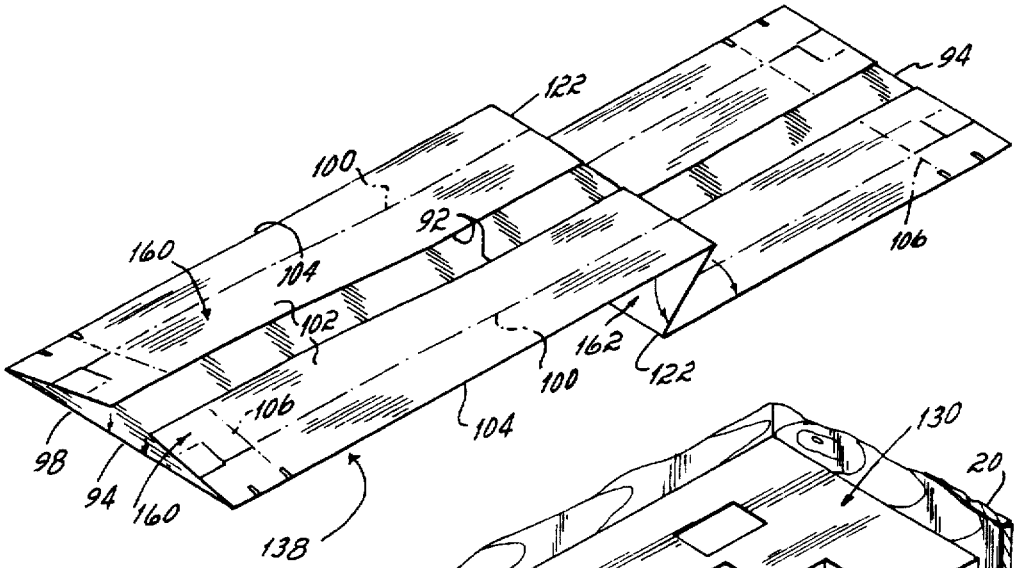
FIG. 10 is a perspective view of the casket floor being constructed from the carton lid.

Once the container 10 including casket kit 16 arrives at the destination point, the kit 16 is removed from the container 10 and is assembled into the casket, for example the casket designated generally by the numeral 26 in FIG. 1. The bottom 12 and top 14 of the shipping carton 10 may then be disassembled back into their blank 30, 31 forms and then may be re-erected into interior components of the casket 26. The carton bottom 12 is erectable into a body support structure 130 (FIGS. 6–9), and the carton top 14 is erectable into a casket floor 132 (FIG. 10).

Referring now to FIGS. 6–9, erection of the body support structure 130 from the blank 30, previously erected into carton bottom 12 for shipping the kit 16 of the casket components, will be described. End portions 132 of the blank 30 defined at each opposed end by transverse lines of perforations 80 are first detached from the balance of the blank 30 to shorten the body support structure 130 such as will fit within the length of the casket 26. Next the longitudinal supporting structure 134 for each lateral edge of the body support structure 130 is formed by folding a lateral edge portion of the cardboard sheet blank 30 beneath the body supporting portion 38 by folding along the score lines 44, 44 and along the score lines 40, 40 to form a first panel portion 46 and a second panel portion 42 of each longitudinal supporting structure 130. The first panel portions 46 are folded to be generally perpendicular to the body supporting portion 38 and the second panel portions 42 are folded so as to underlie the body supporting portion 38.

Next, the first tab portions 66 are folded beneath the body support portion 38. Each first tab portion 66 includes a first panel portion 140 foldably connected to the body supporting portion 38, a second panel portion 142 foldably connected to the first panel portion 140 along adjacent edges at score line 143, and a third panel portion 144 connected to the second panel portion 142 along adjacent edges at score line 145.

The third panel portion 144 includes the prior described notches 78. The second and third tab portions 70 and 72 are likewise folded beneath the body supporting portion 38, and the first, second and third panel portions 140, 142 and 144 of each first tab portion 66 are folded so that notches 78 engage the notches 74 and 76 in the second and third tab portions 70 and 72. The first panel portion 140 of each first tab portion 66 is generally perpendicular the body supporting portion 38 when the first tab portion notches 78 are engaged with the second and third tab portion notches 74 and 76. Further, the second and third tab portions 70, 72 respectively are folded along respective score lines 150, 152 which are generally perpendicular a score line 154 about which the first panel portion 140 of the first tab portion 66 is folded with respect to the body supporting portion 38.

Figure 6:
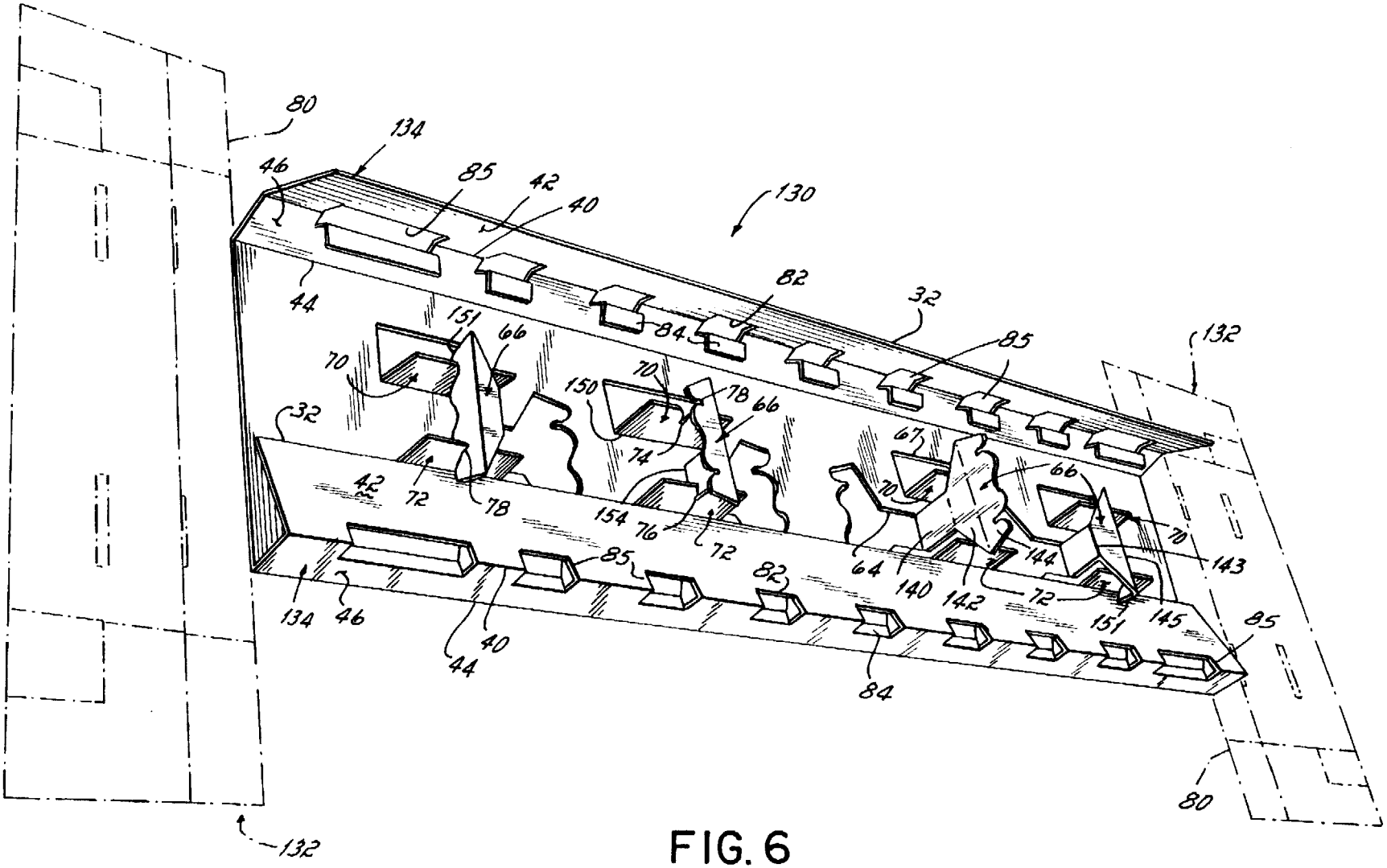
FIGS. 6 and 7 are perspective views of the body support structure being constructed from the carton bottom.
Figure 7:
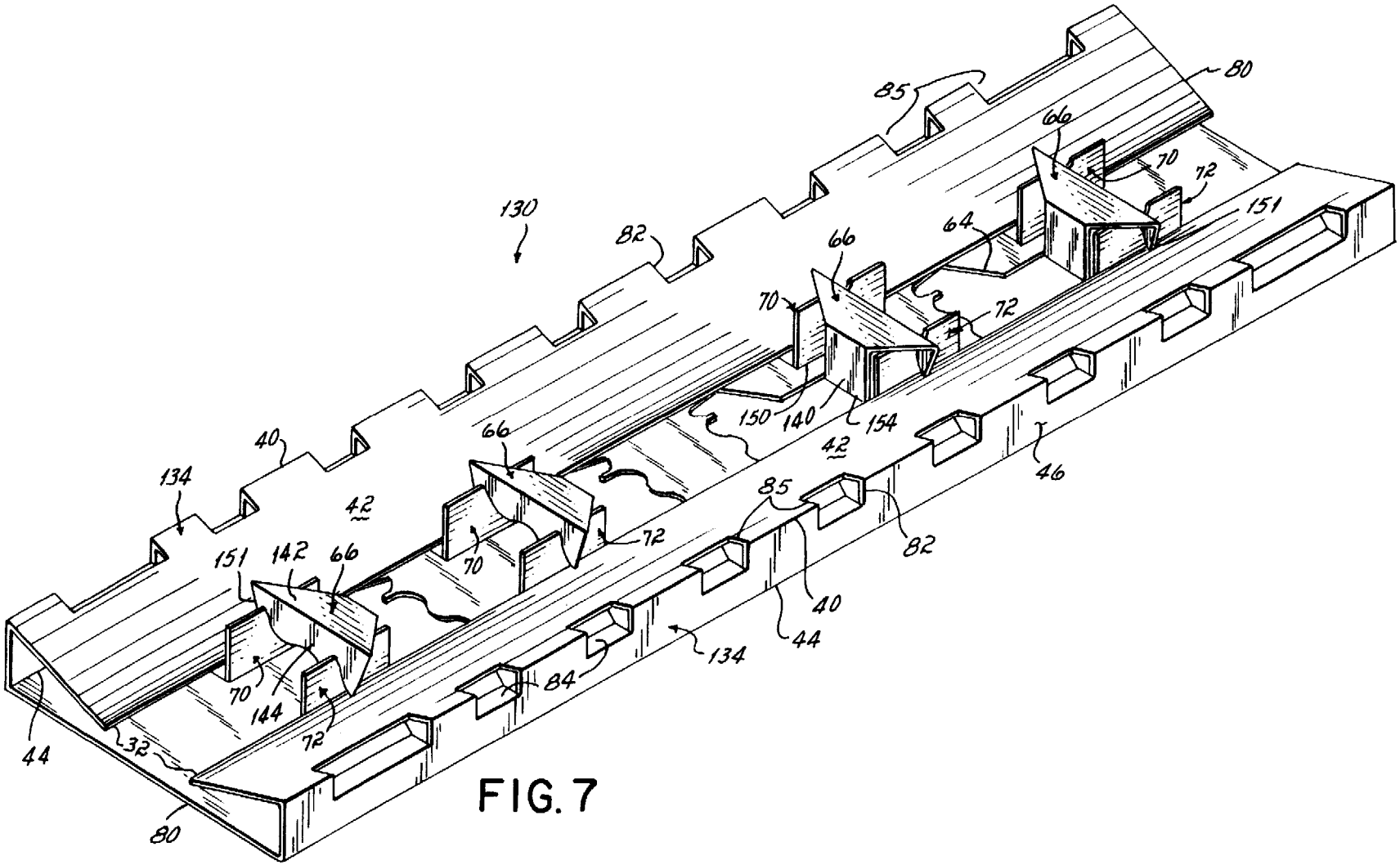
Figures 8, 9:
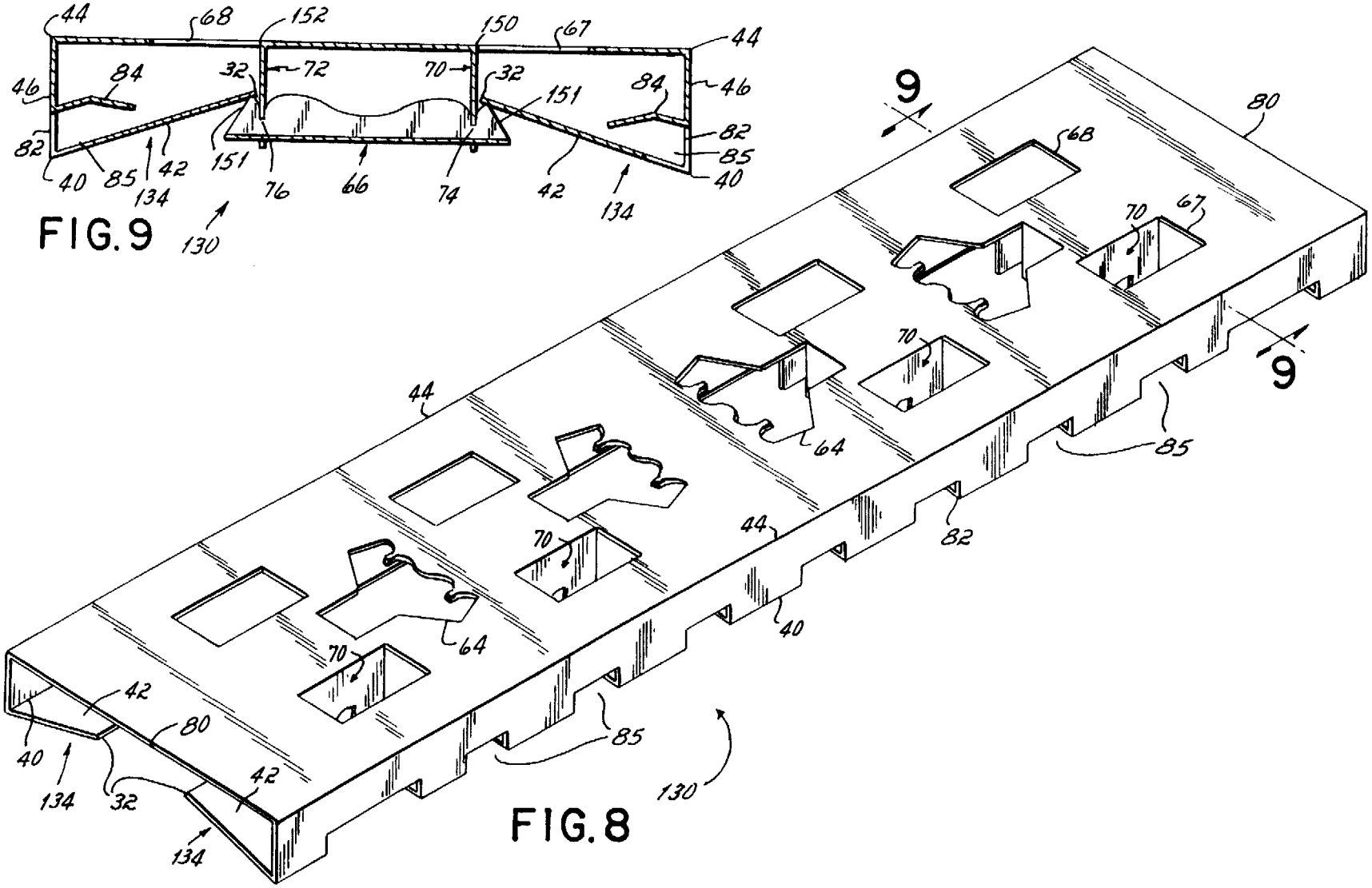
FIG. 8 is a perspective view of the erected, upright body support structure formed by the steps of FIGS. 6 and 7.
FIG. 9 is a view taken along line 9—9 of FIG. 8.
Figure 12:
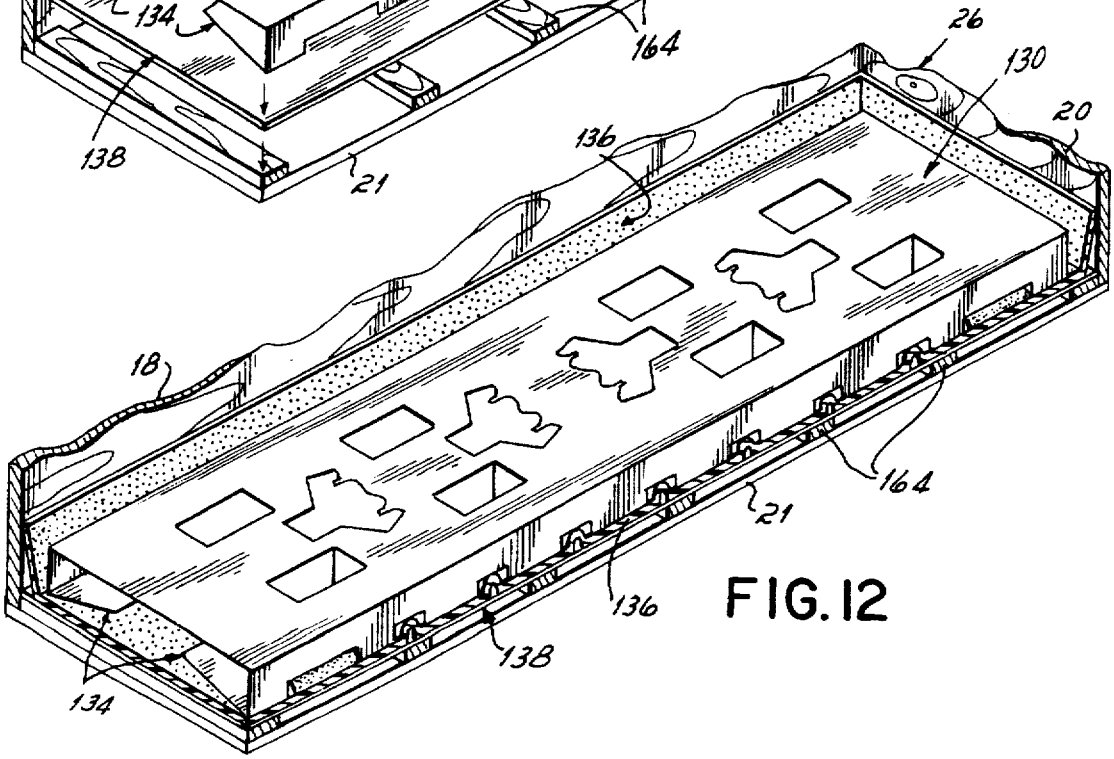
FIG. 12 is an assembled, partial perspective view of the casket shell including the body support structure, casket floor and a liquid retaining tray.

As is seen in FIGS. 6–8, each of the panel portions 46, 42 of each longitudinal supporting structure includes a portion of a notch 85 of a series of notches along and spanning the score line 40. Each of these notches 85, formed by folding a respective notch forming tab 84 about its score line 87, can accept a respective upstanding rib amongst a plurality of upstanding ribs in the bottom of a plastic liquid retaining tray 136 (FIG. 12), for example the plastic liquid retaining tray shown in U.S. Pat. No. Re. 34,846, assigned to the assignee of the present invention and hereby incorporated by reference herein as if fully set forth in its entirety.

As best seen in FIG. 9, the third panel portion 144 of the first tab portion 66 has a pair of lateral edges 151, 151. The free edge 32 of each of the second panel portions 42 is retained by one edge of the third tab portion pair of lateral edges 151, 151 thus retaining the longitudinal supporting structures folded.

As shown in FIG. 10, the carton top 14 may be unfolded back into its blank 32 form as shown in FIG. 3, and then refolded or erected into a floor structure 138 for placement in the bottom of the casket 26. The floor structure 138 is constructed by folding a lateral edge portion of the blank 32 defined by the score lines 104, 104 over beneath the planar floor portion 98 thereby providing longitudinal reinforcing structure 160 along each lateral edge of the floor portion 98 and narrowing the width of the floor structure 138 so as to fit within the assembled casket 26. Next, the structure 138 is folded about the transverse score lines 122, 122 in a lapped configuration to thereby shorten the floor structure 138 so as to fit within the casket 26 and also to provide torso reinforcing structure 162 to be generally located beneath the torso of a deceased supported atop the floor 138 thereby providing additional support beneath this region of concentration of weight of the body.

Figure 11:
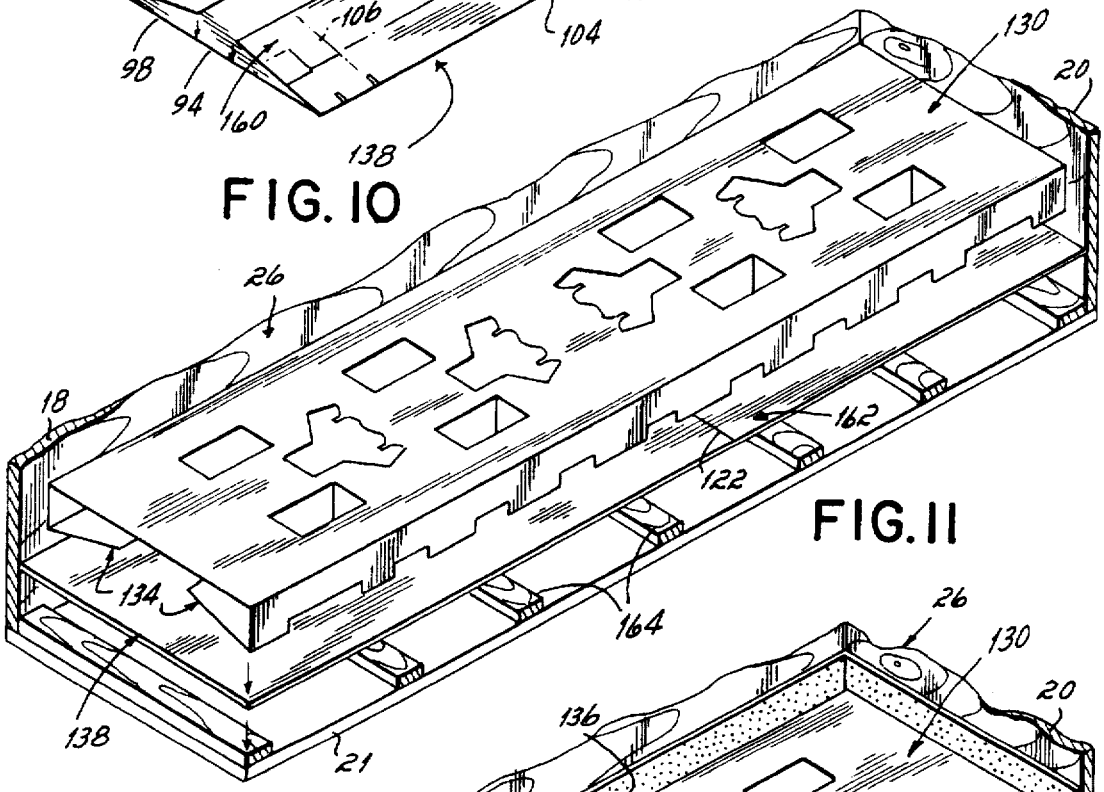
FIG. 11 is an assembled, partial perspective view of the casket shell including the body support structure and casket floor.

As shown in FIG. 11, the floor structure 138 is first placed in the bottom of the casket 26. In the casket of application Ser. No. 08/459,736, the floor structure 138 is placed atop a framework of horizontal slats 164 in lieu of the hardboard panel disclosed therein. Then the upright body support structure 130 is placed atop the floor structure 138. If desired, and as previously described, a plastic liquid retaining tray 136 may be disposed between the floor 138 and body support structure 130.

Figure 13:
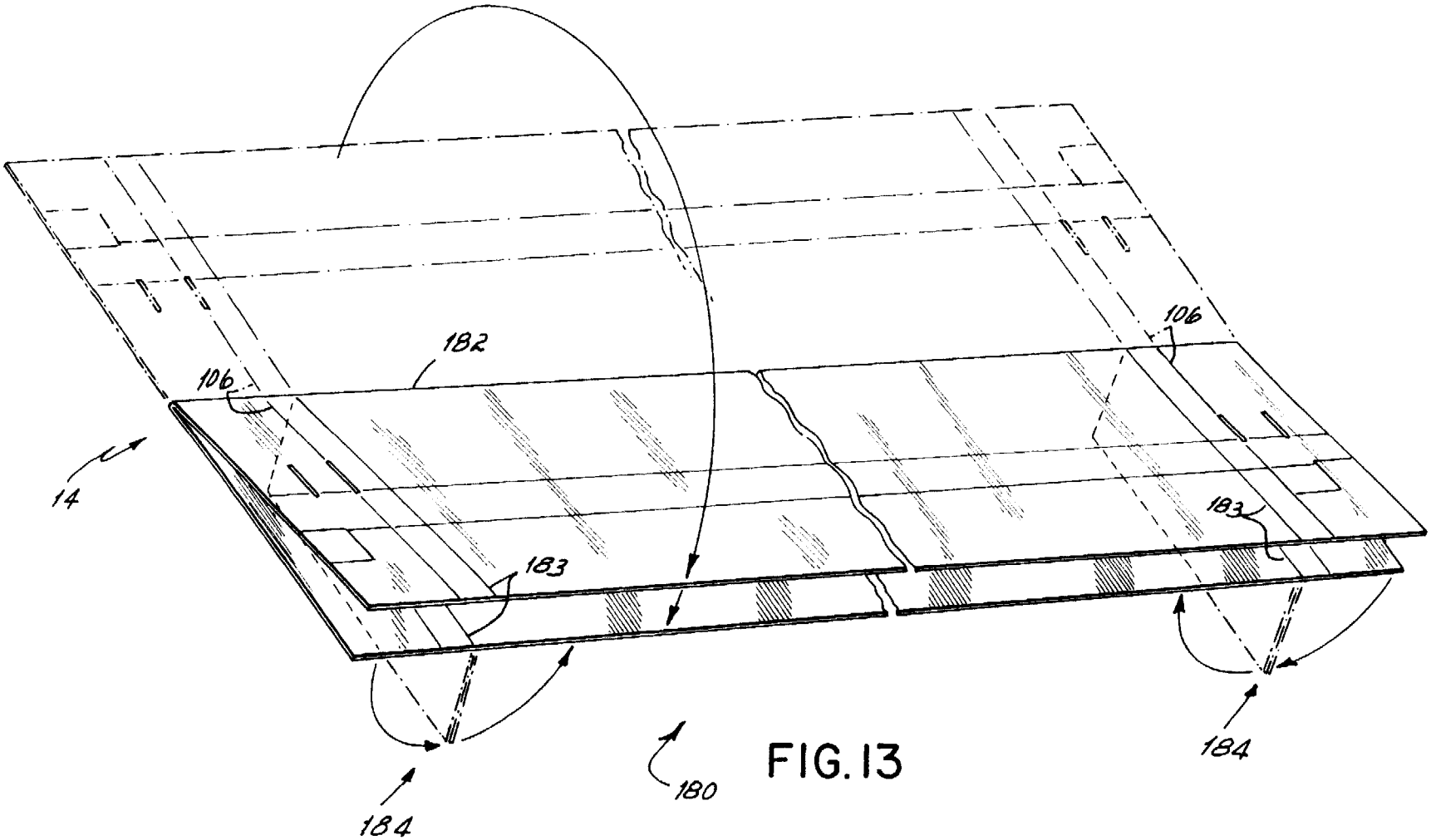
FIG. 13 is a perspective view of an alternative embodiment of the casket floor constructed from the carton lid.

Referring now to FIG. 13, the carton top 14 is shown unfolded and refolded into an alternative form of casket floor structure 180. In this embodiment the floor structure 180 is constructed by folding the blank 32 along a longitudinal center score line 182, narrowing the width of the floor structure 180 so as to fit within casket 26 and providing a double-thickness floor. Next, the structure 180 is folded along each overlapped pair of score lines 183, 183 which are located longitudinally inboard of the score lines 106, 106, so as to fit within casket 26 and also to provide head and foot end reinforcing structure 184 to be generally located beneath the head and feet of a deceased supported atop the floor 180.

Figure 14:
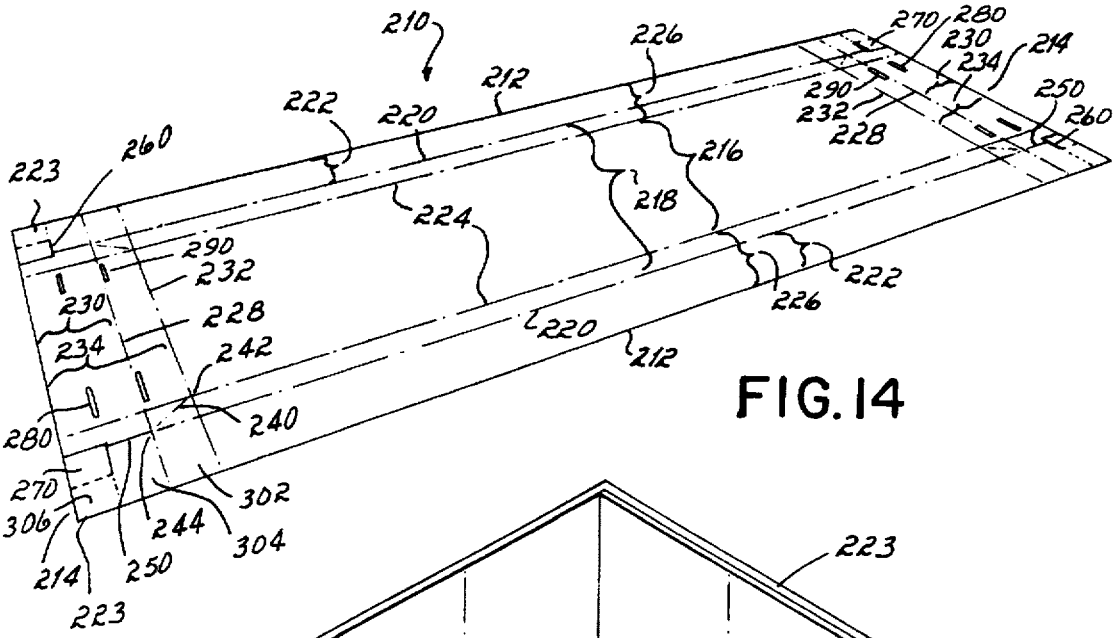
FIG. 14 is a perspective view of a blank for constructing both the top of the FIG. 1 carton and a liquid retaining tray for the casket.

Referring now to FIGS. 14–19, there is shown a version of the carton top 200 which converts into a liquid retaining tray for installation into the casket at the destination point. Referring to FIG. 14, a cardboard blank 210 is coated with a suitable liquid impervious substance, such as Michelman liquid impervious coating. Blank 210 includes a pair of opposed lateral edges 212, 212 and a pair of opposed end edges 214, 214 defining a carton top ceiling 216 and a casket tray floor 218, respectively. Blank 210 further includes a first longitudinal pair of score lines 220, 220 defining a pair of carton top side walls 222, 222. The blank further includes a second longitudinal pair of score lines 224, 224 inboard of the first longitudinal pair of score lines 220, 220 defining a pair of liquid retaining tray side walls 226, 226. A first transverse pair of score lines 228, 228 define a pair of carton top end walls 230, 230, and a second transverse pair of score lines 232, 232 define a pair of liquid retaining tray end walls 234, 234. A score line 240 extends diagonally from each intersection 242 of the ends of the second longitudinal pair of score lines 224, 224 and the second transverse pair of score lines 232, 232 to each respective intersection 244 of the first longitudinal pair of score lines 220, 220 and the first transverse pair of score lines 228, 228. A longitudinal cut line 250 extends from each intersection 244 of the ends of the first longitudinal pair of score lines 220, 220 and the first transverse pair of score lines 228, 228 to a respective end edge 214 of the blank 210. A transverse cut line 260 extends from each longitudinal cut line 250 laterally partially outwardly defining a locking tab 270. A notch 280 in each end of the carton top end wall 228 is for accepting the locking tab 270, as will be subsequently described. An additional notch 290 is for additionally locking the tab 270 in the locked position, as will be subsequently described.

Figure 15:
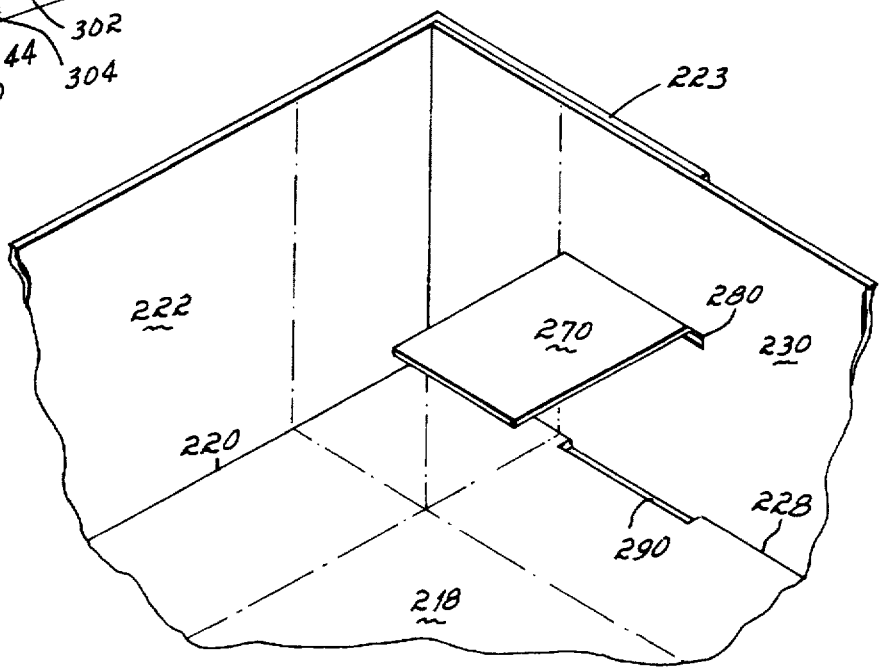
FIG. 15 is a perspective view of a corner of the FIG. 14 blank being assembled into the carton top.
Figure 16:
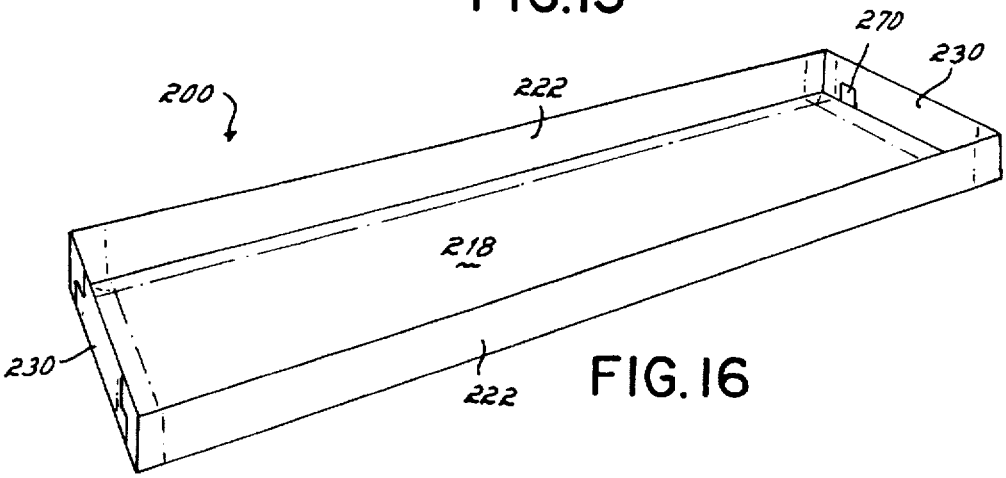
FIG. 16 is a perspective view of the carton top constructed from the FIG. 14 blank.
Figure 17:
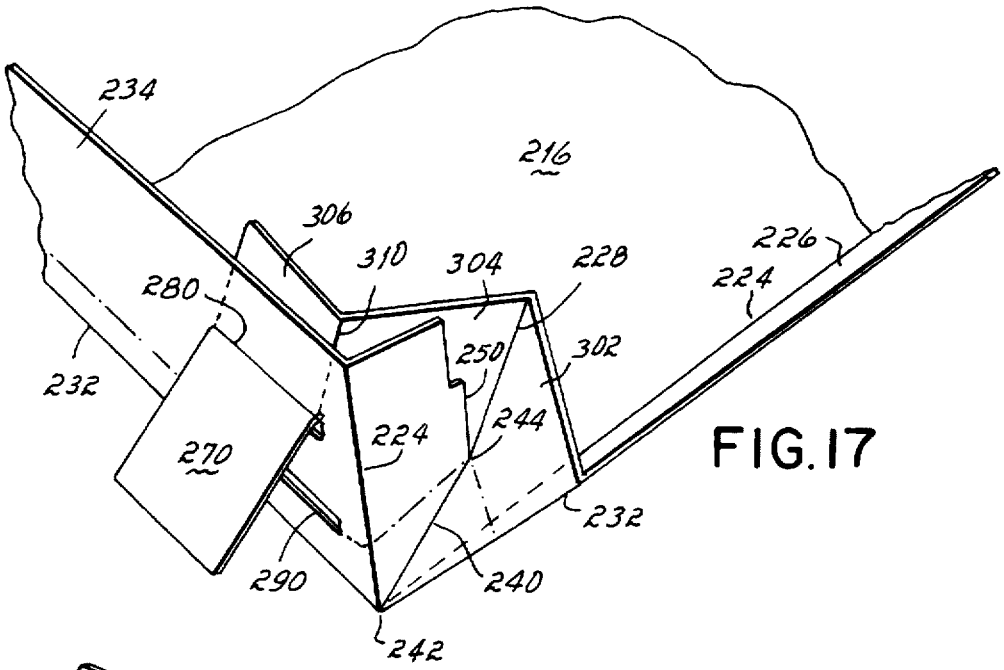
FIGS. 17 and 18 are perspective views of a corner of the FIG. 14 blank being assembled into the liquid retaining tray.
Figure 18:
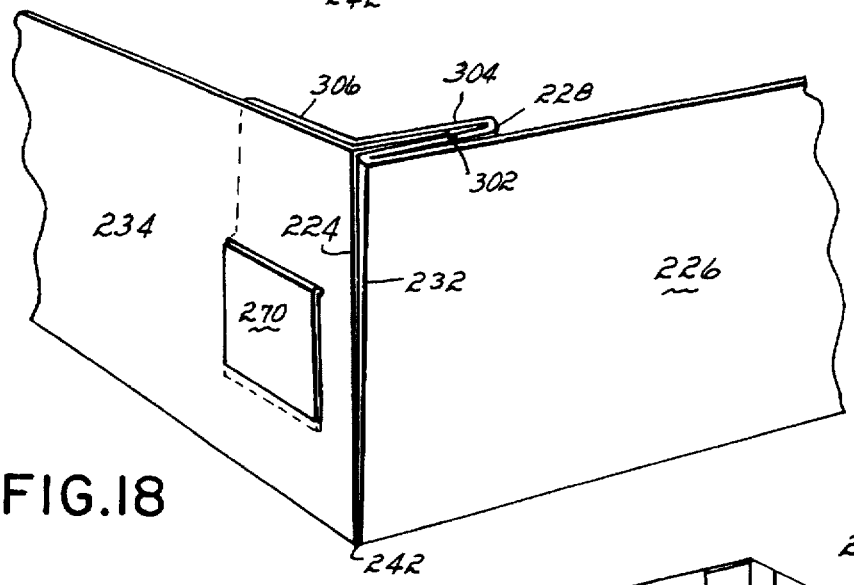

As shown in FIG. 16, the lid 200 is illustrated in its erected shape. To erect the carton lid as shown in FIG. 16, the corners are formed as shown in FIG. 15. The carton lid end walls 230 are first folded upwardly, then the carton lid side walls 222 are folded upwardly. The end portions 223 of the side walls 222 are folded inwardly about the score lines 228, and the locking tab 270 is first passed through slot 280 and is then tucked into slot 290.

Figure 19:
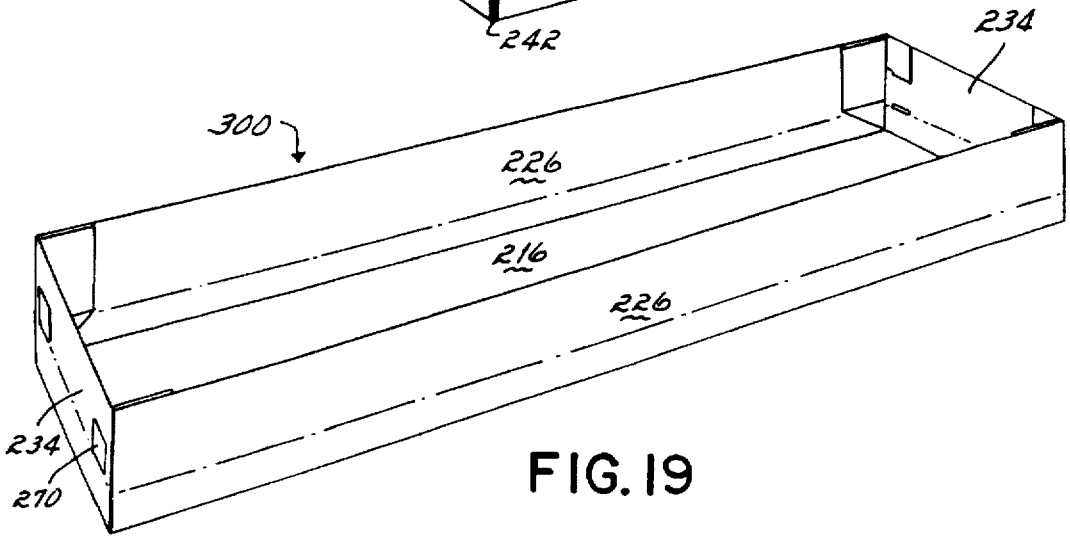
FIG. 19 is a perspective view of the liquid retaining tray constructed from the FIG. 14 blank.

To utilize the carton top 200 as a liquid retaining tray 300, shown erected in FIG. 19, the lid 200 is first unfolded and returned to its blank form as shown in FIG. 14. Then the tray side and end walls 226, 234 respectively are folded upwardly about respective score lines 224 and 232 respectively. The corners are formed by folding a portion of each end of each side and end wall 226, 234 respectively about the diagonal fold lines 240. Tab portions 302, 304 and 306 are folded along the respective score lines 232, 228 and 310 respectively. Tab 270 is inserted first through notch 280 and then into notch 290 to lock the tab 270 in place.

Those skilled in the art will readily recognize numerous adaptations and modifications which can be made of the present invention which will result in an improved method of shipping and assembling a burial casket and casket shipped and assembled by such method, yet all of which will fall within the spirit and scope of the present invention as defined by the following claims. Accordingly, the invention is to be limited only by the scope of the following claims and their equivalents.

What is claimed is:

1. A method of shipping a casket in a knocked-down configuration and subsequently assembling the casket at its point of destination comprising the steps of:

providing a kit of disassembled casket components assemblable into a casket having a shell and a cap;

packing the kit of components into a shipping container;

shipping the packaged casket kit to a destination point;

removing the kit from the container; and assembling the casket from the kit including configuring at least a portion of the container into an interior component of the casket shell and placing the interior component into the shell.

2. A method of shipping a casket in a knocked-down configuration and subsequently assembling the casket at its point of destination comprising the steps of:

providing a kit of disassembled casket components assemblable into a casket having a shell and a cap;

packing the kit of components into a shipping container;

shipping the packaged casket kit to a destination point;

removing the kit from the container; and assembling the casket from the kit including configuring at least a portion of the container into an interior component of the casket and placing the interior component into the casket;

wherein the shipping container is an elongated, shallow, generally rectangular carton having a bottom and a top which fits over the bottom, and wherein the step of configuring at least a portion of the shipping container into an interior component of the casket comprises the steps of:

configuring the carton bottom into a body support structure for supporting a body thereatop and placing the body support structure in the casket; and configuring the carton top into a floor for the casket upon which to support the body support structure and placing the floor in the casket.

3. The method of claim 2 wherein the casket and carton are fabricated from combustible material.

4. The method of claim 3 wherein the casket is fabricated from hardboard and wood and the carton is fabricated from cardboard.

5. A method of shipping a casket in a knocked-down configuration and subsequently assembling the casket at its point of destination comprising the steps of:

providing a kit of disassembled casket components assemblable into a casket having a shell and a cap;

packing the kit of components into a shipping container;

shipping the packaged casket kit to a destination point;

removing the kit from the container; and assembling the casket from the kit including configuring at least a portion of the container into an interior component of the casket and placing the interior component into the casket;

wherein the shipping container is an elongated, shallow, generally rectangular carton having a bottom and a top which fits over the bottom, and wherein the step of configuring at least a portion of the shipping container into an interior component of the casket comprises the steps of:

configuring the carton bottom into a body support structure for supporting a body thereatop and placing the body support structure in the casket; and configuring the carton top into a liquid retaining tray for the casket in which to retain liquids of decomposition of a deceased and placing the liquid retaining tray in the casket.

6. A method of shipping a casket in a knocked-down configuration for subsequent assembly of the casket at its point of destination comprising the steps of:

providing a kit of disassembled casket components assemblable into a casket having a shell and a cap;

providing a shipping container at least a portion of which is adapted to be configured into an interior component of the casket shell for placement therein during assembly thereof;

packing the kit of components into the shipping container; and shipping the packaged casket kit to a destination point.

7. The method of claim 6 further including the steps of:

removing the kit from the container at the destination; and assembling the casket from the kit including configuring at least a portion of the container into an interior component of the casket shell and placing the interior component into the shell.

8. The method of claim 7 wherein the shipping container is an elongated, shallow, generally rectangular carton having a bottom and a top which fits over the bottom, and wherein the step of configuring at least a portion of the shipping container into an interior component of the casket shell comprises the steps of:

configuring the carton bottom into a body support structure for supporting a body thereatop and placing the body support structure in the casket; and configuring the carton top into a floor for the casket upon which to support the body support structure and placing the floor in the casket.

9. The method of claim 8 wherein the casket and carton are fabricated from combustible material.

10. The method of claim 9 wherein the casket is fabricated from hardboard and wood and the carton is fabricated from cardboard.

11. The method of claim 7 wherein the shipping container is an elongated, shallow, generally rectangular carton having a bottom and a top which fits over the bottom, and wherein the step of configuring at least a portion of the shipping container into an interior component of the casket shell comprises the steps of:

configuring the carton bottom into a body support structure for supporting a body thereatop and placing the body support structure in the casket; and configuring the carton top into a liquid retaining tray for the casket in which to retain liquids of decomposition of a deceased and placing the liquid retaining tray in the casket.

12. A method of receiving a casket shipped in a knocked-down configuration and assembling the casket at its point of destination comprising the steps of:

receiving a kit of disassembled casket components assemblable into a casket having a shell and a cap and packed into a shipping container;

removing the kit from the container; and assembling the casket from the kit including configuring at least a portion of the container into an interior component of the casket shell and placing the interior component into the shell.

13. The method of claim 12 wherein the shipping container is an elongated, shallow, generally rectangular carton having a bottom and a top which fits over the bottom, and wherein the step of configuring at least a portion of the shipping container into an interior component of the casket shell comprises the steps of:

configuring the carton bottom into a body support structure for supporting a body thereatop and placing the body support structure in the casket; and configuring the carton top into a floor for the casket upon which to support the body support structure and placing the floor in the casket.

14. The method of claim 13 wherein the casket and carton are fabricated from combustible material.

15. The method of claim 14 wherein the casket is fabricated from hardboard and wood and the carton is fabricated from cardboard.

16. The method of claim 12 wherein the shipping container is an elongated, shallow, generally rectangular carton having a bottom and a top which fits over the bottom, and wherein the step of configuring at least a portion of the shipping container into an interior component of the casket shell comprises the steps of:

configuring the carton bottom into a body support structure for supporting a body thereatop and placing the body support structure in the casket; and configuring the carton top into a liquid retaining tray for the casket in which to retain liquids of decomposition of a deceased and placing the liquid retaining tray in the casket.

17. The method of claim 12 further comprising, prior to receiving and assembling the casket kit, the steps of:

providing a kit of disassembled casket components assemblable into a casket having a shell and a cap;

packing the kit of components into a shipping container; and shipping the packaged casket kit to a destination point.

18. A method of shipping a casket in a knocked-down configuration for subsequent assembly of the casket at its point of destination comprising the steps of:

providing a kit of disassembled casket components assemblable into a casket having a shell and a cap;

providing a shipping carton having a bottom and a top which fits on the bottom, one of the carton top and bottom being adapted to be configured into a body support structure for placement in the casket;

packing the kit of components into the shipping carton; and shipping the packaged casket kit.

19. A method of shipping a casket in a knocked-down configuration for subsequent assembly of the casket at its point of destination comprising the steps of:

providing a kit of disassembled casket components assemblable into a casket having a shell and a cap;

providing a shipping carton having a bottom and a top which fits on the bottom, one of the carton top and bottom being adapted to be configured into a floor for placement into the casket;

packing the kit of components into the shipping carton; and shipping the packaged casket kit.

20. A method of shipping a casket in a knocked-down configuration for subsequent assembly of the casket at its point of destination comprising the steps of:

providing a kit of disassembled casket components assemblable into a casket having a shell and a cap;

providing a shipping carton having a bottom and a top which fits on the bottom, one of the carton top and bottom being adapted to be configured into a liquid retaining tray for placement in the casket;

packing the kit of components into the shipping carton; and shipping the packaged casket kit.

21. A method of receiving a casket shipped in a knocked-down configuration and assembling the casket at its point of destination comprising the steps of:

receiving a kit of dissassembled casket components assemblable into a casket having a shell and a cap and packed in a shipping carton having a bottom and a top which fits on the bottom;

removing the kit from the carton; and assembling the casket from the kit including configuring at least one of the carton top and bottom into a body support structure and placing the body support structure in the casket.

22. A method of receiving a casket shipped in a knocked-down configuration and assembling the casket at its point of destination comprising the steps of:

receiving a kit of dissassembled casket components assemblable into a casket having a shell and a cap and packed in a shipping carton having a bottom and a top which fits on the bottom;

removing the kit from the carton; and assembling the casket from the kit including configuring at least one of the carton top and bottom into a liquid retaining tray and placing the liquid retaining tray in the casket.

23. A method of receiving a casket shipped in a knocked-down configuration and assembling the casket at its point of destination comprising the steps of:

receiving a kit of dissassembled casket components assemblable into a casket having a shell and a cap and packed in a shipping carton having a bottom and a top which fits on the bottom;

removing the kit from the carton; and assembling the casket from the kit including configuring at least one of the carton top and bottom into a floor and placing the floor in the casket.

* * * * *